US005853141A

United States Patent [19]

Heiber et al.

[11] Patent Number: 5,853,141

[45] Date of Patent: Dec. 29, 1998

[54] METHOD AND APPARATUS FOR AUTOMATICALLY EXCHANGING FOIL ROLLS, PARTICULARLY IN THE MANUFACTURE OF FOLDING BOXES WITH FOIL WINDOWS

[76] Inventors: Wolfgang Heiber, Überhaan 16; Julius Schröder-Frerkes, Trills 110, both of 40699 Erkrath, Germany

[21] Appl. No.: 766,232

[22] Filed: Dec. 12, 1996

[30] Foreign Application Priority Data

Feb. 28, 1996 [DE] Germany ..... 196 07 495.9

[51] Int. Cl.[6] ..... B65H 19/18

[52] U.S. Cl. ..... 242/552; 242/554.2; 242/554.3; 156/504

[58] Field of Search ..... 242/552, 554, 242/554.2, 554.3; 156/504, 505, 506

[56] References Cited

U.S. PATENT DOCUMENTS

| | | | |
|---|---|---|---|
| 2,236,163 | 3/1941 | Barber | 242/554.2 |
| 2,621,865 | 12/1952 | Wieking | 242/554.3 |
| 3,610,547 | 10/1971 | Anderson | 242/552 |
| 3,627,616 | 12/1971 | Davis | 242/552 |
| 3,858,819 | 1/1975 | Butler, Jr. | 242/552 |
| 3,873,393 | 3/1975 | Bruck et al. | 242/555.1 |
| 3,886,031 | 5/1975 | Taitel | 242/552 |
| 4,100,012 | 7/1978 | Meihofer et al. | 242/554.5 |
| 4,106,974 | 8/1978 | Hirsch | 156/504 |
| 4,108,391 | 8/1978 | Martinez | 242/552 |
| 4,157,934 | 6/1979 | Ryan et al. | 156/505 |
| 4,190,483 | 2/1980 | Ryan et al. | 156/504 |
| 4,331,301 | 5/1982 | Martinez | 156/505 |
| 4,345,709 | 8/1982 | Barton | 242/554.5 |
| 4,543,152 | 9/1985 | Nozaka | 242/552 |
| 4,629,531 | 12/1986 | Kataoka | 242/555.1 |
| 5,411,223 | 5/1995 | Gatteschi | 242/552 |
| 5,514,237 | 5/1996 | Emenaker et al. | 156/504 |

FOREIGN PATENT DOCUMENTS

| | | | |
|---|---|---|---|
| 0391927 | 10/1990 | European Pat. Off. . | |
| 2434227 | 2/1975 | Germany . | |
| 3129496 | 2/1983 | Germany . | |
| 59-207351 | 11/1984 | Japan | 242/552 |
| 63-97560 | 4/1988 | Japan | 242/552 |
| 3-102057 | 4/1991 | Japan | 242/554.2 |
| WO 91/16256 | 10/1991 | WIPO | 242/552 |

*Primary Examiner*—John P. Darling
*Attorney, Agent, or Firm*—Friedrich Kneffner

[57] ABSTRACT

A method and an apparatus for automatically exchanging foil rolls, particularly in the manufacture of folding boxes with foil windows, wherein the end of one foil web is automatically connected to the beginning of the next following foil web. The method includes the steps of temporarily holding the end portion of the foil web which is about to run out, simultaneously connecting the end portion to the beginning of the next foil web, releasing the end portion after the connection has been effected, subsequently severing the end of the first foil web and, during these steps, further conveying without interruptions the foil web from a loop. The apparatus includes a connecting station arranged upstream of a folding box production plant in the sequence of operation, the connecting station including a turnstile on which the foil rolls with foil webs are arranged.

7 Claims, 3 Drawing Sheets

15
30
27
14
14'
8
9
13
13'
23
8
22
7
12
12'
11
11'
10
6
1
5
31

METHOD AND APPARATUS FOR AUTOMATICALLY EXCHANGING FOIL ROLLS, PARTICULARLY IN THE MANUFACTURE OF FOLDING BOXES WITH FOIL WINDOWS

BACKGROUND OF THE INVENTION

1. Field of the Invention

The present invention relates to a method and an apparatus for automatically exchanging foil rolls, particularly in the manufacture of folding boxes with foil windows.

2. Description of the Related Art

In known methods for manufacturing folding boxes with foil windows, a cardboard blank is removed continuously or cyclically from a magazine, such as preferably a stack, and the cardboard blank is then aligned laterally and in travel direction in a subsequently arranged aligning section. Glue is then applied to the cardboard blank by means of a stereotype cylinder or gluing system. The foil is continuously pulled in the form of foil web from a roll, the foil is cut to length into individual pieces, the pieces are glued onto the cardboard provided with glue.

For example, DE-OS-24 34 227 discloses an apparatus for transferring a paper strip, particularly a window cover onto a web of window envelopes which are previously provided with glue. The apparatus includes a device for advancing the paper strip.

DE-A-31 29 496 discloses a method for continuously manufacturing folding boxes in which a foil piece of flexible synthetic material is glued over the area of the window opening. The foil is pulled from a supply roll, the foil is cut into pieces and is glued with exact fit over the previously punched areas of the window openings.

EP-O 391 927 B1 discloses a method for manufacturing foil blanks for folding boxes with angular windows, wherein foil blanks of a transparent synthetic material are glued into folding box blanks provided with a cutout. The material for the foil blanks is continuously unwound from a roll and the foil blanks are glued onto the folding box blanks for manufacturing folding boxes.

In the prior art, the foil rolls are usually arranged outside of the actual gluing machine and are tensioned, for example, on a shaft with truncated cones on both sides. It is also possible to slide foil rolls onto a shaft and to secure the foil rolls on the shaft by means of compressed air, for example, by means air bags. The roll exchange is simplified if the shafts of the foil rolls are cantilevered.

However, the very time-consuming exchange of the foil rolls is generally a problem because the exchange of a foil roll may lead to undesired interruptions of the otherwise continuous production sequence. In addition, the arrangement of several redundant foil rolls requires a relatively large space.

None of the references discussed above disclose suggestions toward methods or apparatus components for rendering the clear foil endless when the end of a supply roll is reached or toward an automatic roll exchange.

SUMMARY OF THE INVENTION

Therefore, taking into consideration the afore-mentioned state of the art, it is the primary object of the present invention to provide a method and an apparatus for an automatic roll exchange in an automatic production plant for folding boxes with foil windows without interruptions in the production, wherein the end of one foil web is automatically connected to the beginning of the next following foil web. In addition, the apparatus should be relatively uncomplicated and should only require little space.

In accordance with the present invention, the method described above includes the steps of temporarily holding the end portion of the foil web which is about to run out, simultaneously connecting the end portion to the beginning of the next foil web, releasing the end portion after the connection has been effected, subsequently severing the end of the first foil web and, during these steps, further conveying without interruptions the foil web from a loop.

The apparatus according to the present invention for automatically exchanging foil rolls, particularly in the manufacture of folding boxes with foil windows for carrying out the method described above, includes a connecting station arranged upstream of a folding box production plant in the sequence of operation, the connecting station including a turnstile on which the foil rolls with foil webs are arranged.

The method and apparatus according to the present invention have the significant advantage that the exchange of foil rolls takes place fully automatically without interrupting the production of manufacturing folding boxes in a single connecting and exchange station. Moreover, the connecting station constitutes an independent element of the production plant, is of uncomplicated construction and is also advantageously suitable, for example, for refitting existing production plants.

Another advantage of the method and the apparatus of the invention results from the relatively short distance between the point where the foil is rolled off and a transverse cutter of the production plant as compared to the prior art. As a result, auxiliary elements, such as turning rods and guide posts, are unnecessary; these auxiliary elements could lead to the danger that scratches occur on the foils and that the foil does not run quietly. Moreover, compared to existing plants, the apparatus according to the present invention is of substantially simpler construction.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
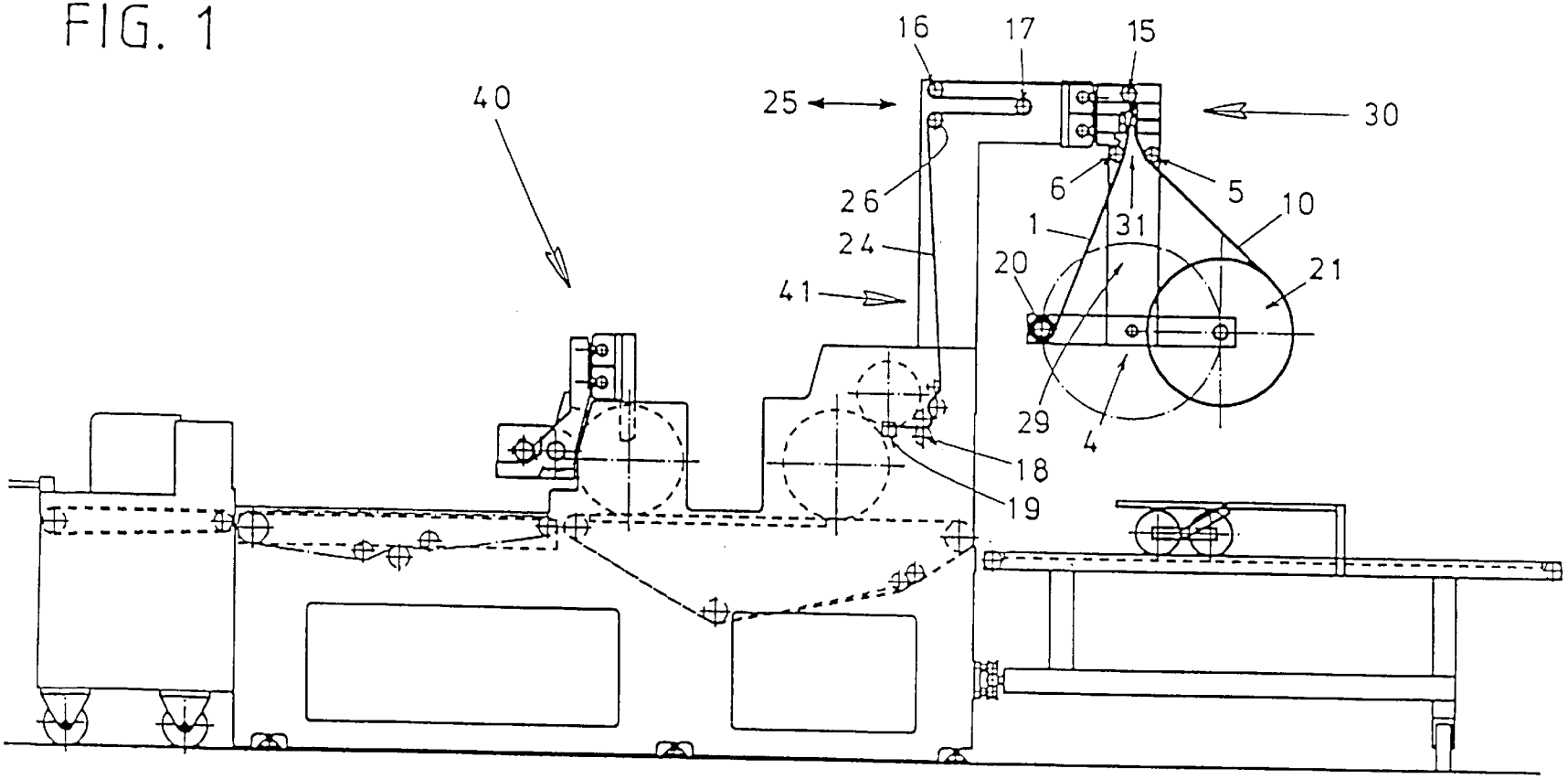
FIG. 1 is a schematic side view of a folding box production plant.

FIG. 1 of the drawing shows the complete folding box production plant according to the present invention with a plant component 40 for continuously manufacturing folding boxes and, arranged upstream of the plant component 40 in the production sequence, a plant component 30 for supplying an endless foil web 24 and for exchanging the foil rolls;

in the following the plant component 30 will be referred to as the connecting station 30. The foil rolls 20, 21 are arranged on a turnstile 4; the foil webs 1, 10 are pulled from the foil rolls 20, 21.

Figure 2:
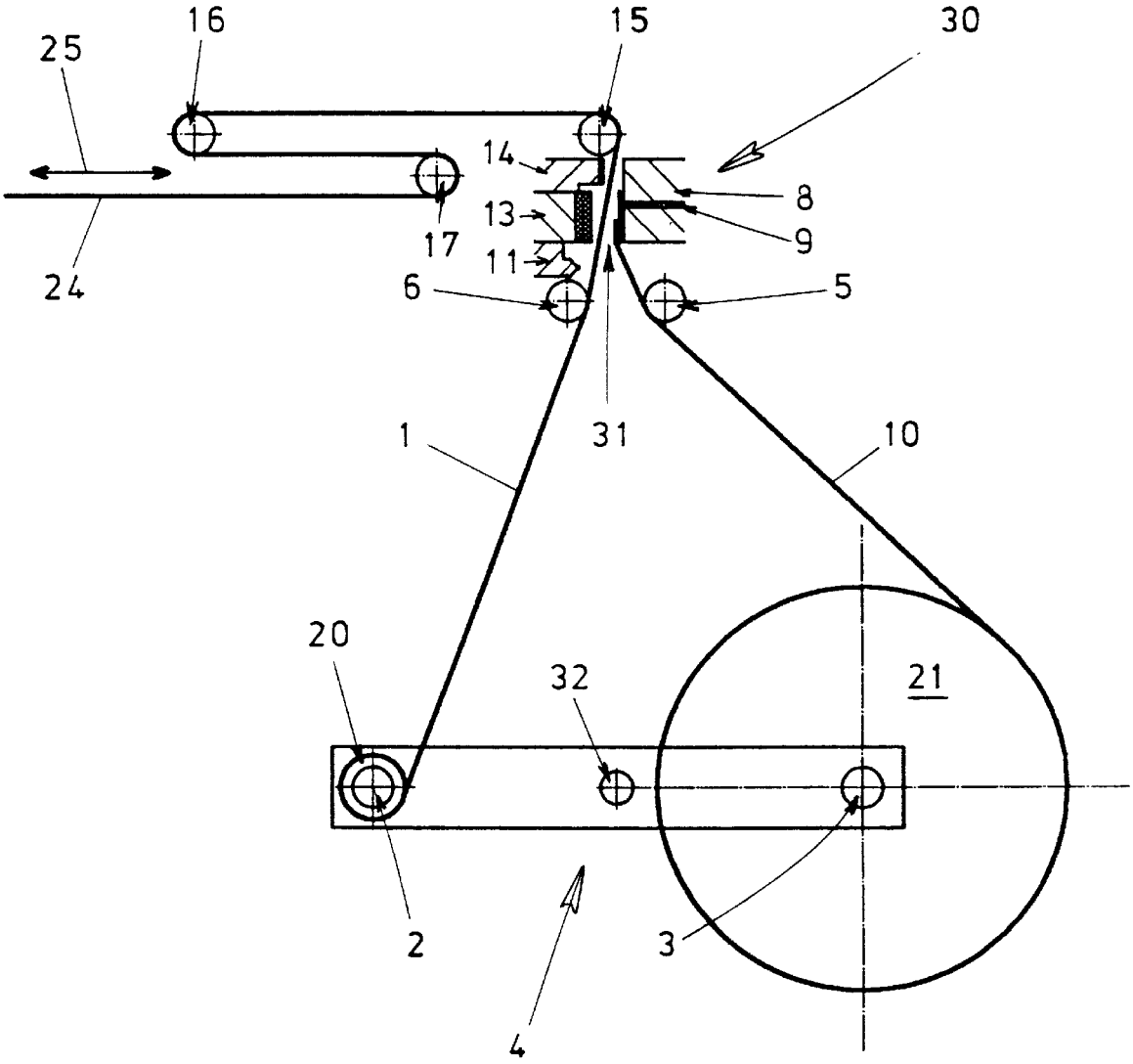
FIG. 2 is a schematic view, on a larger scale, of a station for connecting two foil webs and for exchanging foil rolls.
Figure 3:
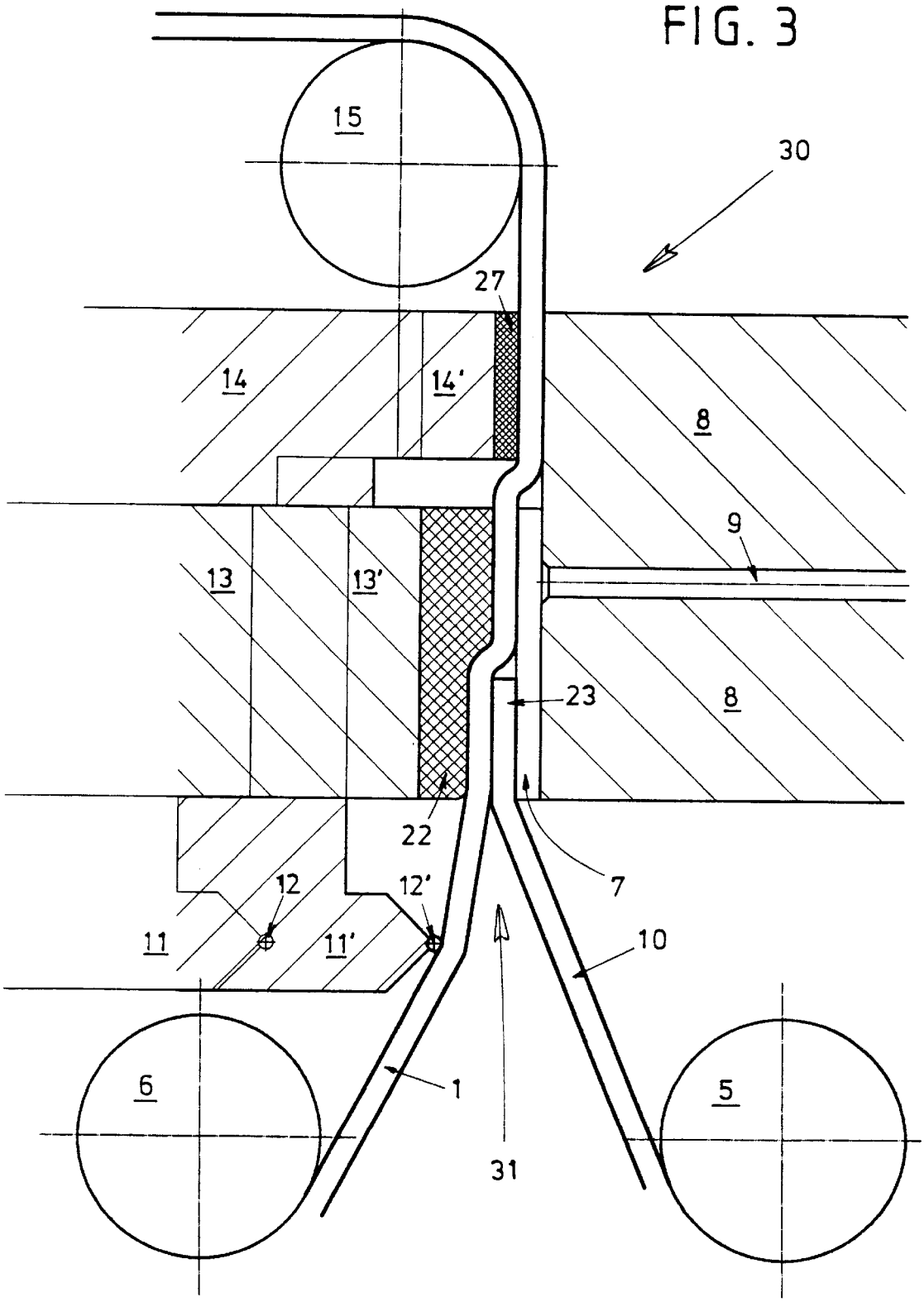
FIG. 3 shows a detail of the connecting station of FIG. 2 on an even larger scale.

As illustrated in FIGS. 2 and 3, the connecting station 30 has a work gap 31 formed between a pressure plate 8, on the one hand, and, on the other hand, a clamping beam 14 arranged so as to be movable relative to the pressure plate 8, a pressure die 13 located below the clamping beam 14 and a carrier 11 for an incandescent wire 12. Independent means are provided for moving the clamping beam 14, the pressure die 13 and the carrier 11 into the work positions 14', 13', 11', respectively. Provided in the pressure plate 8 is a duct 9 for suction air, wherein the duct 9 is connected to a negative pressure source, not shown.

Two guide rollers 5, 6 for the foil webs 1, 10 are arranged below the work gap 31 and a guide roller 15 for the exiting foil web 24 is arranged above the work gap 31. When the foil webs 1, 10 are connected to each other during an exchange of the foil rolls, 20, 21, the foil web 24 is supplied without interruption to the folding box production plant 40.

A turnstile 4 arranged in front of the connecting station 30 on a vertical support beam 29 includes means for swinging the turnstile about 180°, not shown. Of course, this swinging movement can also be effected manually. A storage means for the foil web 24 is provided between the connecting station 30 and the folding box production plant 40. The storage means includes a resiliently movable looping or storage roller 17 and stationary guide rollers 16, 26. When the web is clamped temporarily, the looping roller 17 interacts with the two stationary guide rollers 16, 26 by moving toward the left in the direction of arrow 25 as shown in FIGS. 1 and 2, so that the foil web 24 is released at a constant speed from a loop formed between the storage roller 17 and the guide rollers 16, 26 in order to maintain a constant sequence of operation.

The connecting station 30 operates as follows.

The foil web 1 of the foil roll 20 which is about to be used up and is arranged on the shaft 2 travels over the stationary guide roller 6, 15, 16 and over the movable looping roller 17 and, from the roller 17, over the stationary guide roller 26 to the tension rollers 18 of the folding box production plant 40 shown in FIG. 1 and to the transverse cutter 19.

As illustrated in FIG. 3, prior to an exchange of foil rolls 20, 21, the free end 23 of the new foil web 10 is guided from the foil roll 21 into the work gap 31 of the connecting station 30 and is glued to the lower half of a unilaterally adhesive strip 7 which is releasably held with the non-adhesive side against the counter pressure plate 8 by means of suction air through bores 9.

As is apparent from FIGS. 1–3, the looping roller 17 is initially in its starting point. When the exchange process is initiated, the clamping beam 14 with the rubber ledge 27 is moved into the clamping position 14' against the counter pressure plate 8 and clamps the foil 1 in this manner.

Since the tension rollers 18 continue to rotate, the looping roller 17 travels relative to the stationary guide roller 16, 26 toward the left in the direction of arrow 25 so as to release a stored length of foil 24 and, thus, acts as a loop storage unit. Immediately after the foil 1 has been clamped by means of the clamping beam 14, the pressure die 13 is moved with the rubber ledge 22 into the pressing position 13– against the counter pressure plate 8 and causes the foil 1 to be glued to the uncovered portion of the adhesive strip 7 and, consequently, the foil 10 is glued to the end of the foil 1 which is about to run out. Immediately following the pressing action by the pressing die 13 with the rubber ledge 22, the carrier 11 is moved into the position 11' in order to move the incandescent wire 12 against the foil 1 and to cut the foil 1 when the incandescent wire is in the cutting position 12'.

Subsequently, the elements 11, 13, 14 are returned into their initial positions and the suction air of the bore 9 drops off. The restoring force of the deflected looping roller 17 and the pulling action by the tension rollers 18 cause the foil 10 of the new foil roll 21 to rotate on the shaft 3 and the looping roller 17 is again returned into its initial position. The turnstile 4 is then turned about the axis of rotation 32 by 180° toward the left as seen in the drawing, so that the shaft 3 is now in the original position of shaft 2.

The residual roll 20 is then removed by the shaft 2 and replaced by a new roll. The free end of the new roll, now again in the position of roll 21, is provided with a new unilaterally adhesive strip 7 and, as shown in FIGS. 2 and 3, the free end of the new roll with the adhesive strip 7 is placed against the lower portion of the counter pressure plate 8 and is held in this position by means of suction air supplied through bore 9. The steps of turning the turnstile, exchanging the rolls, placing and positioning the adhesive strip 7 can be carried out optionally either manually or by using appropriate mechanical devices.

The method described above can be used separately or especially in combination with a window gluing plant 40 as shown in FIG. 1. The sequence of the movements is not fixed. Also, instead of cutting the foil 1 of the foil roll 20 which is used up by means of a heating wire 12, the foil can also be cut by means of, for example, a serrated knife which engages in a counter-frame. Instead of using a clamping beam 14 shown in FIG. 3, the foil 1 can also be held, for example, by means of the roll 20. The gluing process can be carried out as described above and the rolls can be exchanged or the positions thereof shifted. The looping roll 17 can be provided twice in order to increase the length of the storage loop and the entire roll changing unit 30 can be constructed so as to be movable sideways.

In accordance with an embodiment of the unit, the work gap 31 may include a device for introducing an adhesive foil 7. An advantageously uncomplicated concept of the plant is achieved by mounting the connecting and exchanging station 30 on a cantilever arm 41 of the folding box production plant 40.

An advantageous further development of the plant provides that the connecting station 30 includes means for laterally displacing the connecting station 30 transversely of the travel direction of the foil web 1 or 24. This makes it possible that the foil web travels exactly in the desired position in alignment especially with the subsequent folding box production plant 40.

The apparatus is not limited to the embodiment illustrated in the drawing as an example. Rather, individual components of the apparatus can be arranged in a different sequence relative to each other or the construction of individual components may be modified as deemed necessary by skilled artisans. Also, instead of an incandescent wire 12, it is possible to use , for example, cutting means for separating the foil web 1.

While specific embodiments of the invention have been shown and described in detail to illustrate the inventive principles, it will be understood that the invention may be embodied otherwise without departing from such principles.

We claim:

1. A method of manufacturing folding boxes or folding box blanks with foil windows, wherein foils pulled from supply rolls are glued over openings in the folding boxes or folding box blanks, the method comprising guiding a foil pulled from a supply roll by means of a tension roller through a work gap defined in a first plant component, the work gap having an adjustable gap width, forming the foil into a loop and subsequently guiding the foil from the loop over a short distance to a transverse cutter of a second plant component, temporarily holding an end portion of a first foil web which is about to run out, subsequently pressing in the work gap the end portion of the first foil web against a beginning of a second foil web already present in the work gap and connecting the end portion of the first foil web to the beginning of the second foil web, subsequently severing the first foil web at a location underneath the work gap, releasing the second foil web, wherein during temporarily holding the foil web the foil is continuously supplied from the loop to the transverse cutter of the second plant component, further comprising turning by 180° a turnstile supporting the supply rolls so as to exchange positions of the supply rolls of the first and second foil webs, replacing an empty supply roll by a new supply roll, inserting a free end of the new supply roll into a lower portion of the work gap and holding the free end of the supply roll together with an adhesive foil within the work gap by means of suction air.

2. The method according to claim 1, comprising effecting the step of temporarily holding an end portion of the first foil web by holding the first foil web at least at one location.

3. An apparatus for manufactoring folding boxes or folding box blanks with foil windows, the apparatus comprising a first plant component for supplying foil and a second plant component for gluing the foil onto openings of the folding box blanks, wherein the foils are pulled from supply rolls, a looping roller for the foil mounted between the first plant component and the second plant component, further comprising two stationary guide rollers interacting with the looping roller so as to form a storage loop of the foil, the second plant component having a cantilever arm, the first plant component being mounted on the cantilever arm, the first plant component having a turnstile, the supply rolls being arranged on the turnstile so as to be swingable by the turnstile, the first plant component having a work gap with an adjustable gap width, the work gap being defined by a pressure plate and a clamping beam mounted movably relative to the pressure plate, further comprising a pressure die located below the clamping beam and a severing means mounted on a support, further comprising means for moving in parallel direction the clamping beam, the pressure die and the support toward the work gap into a work position, and means for inserting the foil and an adhesive foil into the work gap, wherein the pressure plate defines a duct for suction air connected to a negative pressure source.

4. The apparatus according to claim 3, further comprising means for swinging the turnstile by 180°.

5. The apparatus according to claim 3, comprising two guide rollers underneath the work gap and an additional guide roller above the work gap.

6. The apparatus according to claim 3, comprising tension rollers for the foil and a transverse cutting means arranged upstream of the second plant component.

7. The apparatus according to claim 3, wherein the connecting station comprises first plant component means for laterally displacing the first plant component transversely of a travel direction of the foil.

* * * * *